US011699413B2

(12) United States Patent
Lee

(10) Patent No.: US 11,699,413 B2
(45) Date of Patent: Jul. 11, 2023

(54) AFTERIMAGE COMPENSATION DEVICE AND DISPLAY DEVICE INCLUDING THE SAME

(71) Applicant: Samsung Display Co., Ltd., Yongin-si (KR)

(72) Inventor: Jun Gyu Lee, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/445,173

(22) Filed: Aug. 16, 2021

(65) Prior Publication Data

US 2022/0114986 A1 Apr. 14, 2022

(30) Foreign Application Priority Data

Oct. 14, 2020 (KR) ..... 10-2020-0132512

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/0257* (2013.01); *G09G 2320/0646* (2013.01)

(58) Field of Classification Search
CPC .... G09G 5/10; G09G 3/20; G09G 2320/0257; G09G 2320/0646; G09G 2300/08; G09G 2320/0242; G09G 2320/0285; G09G 2320/046; G09G 2330/10; G09G 2330/12; G09G 2320/0233
See application file for complete search history.

(56) References Cited

U.S. PATENT DOCUMENTS 9,666,116 B2 * 5/2017 Jung ..... G09G 3/2003
2005/0212726 A1 * 9/2005 Namba ..... G09G 3/22 345/63
2014/0146071 A1 * 5/2014 Kim ..... G09G 3/3225 345/589
2015/0130860 A1 * 5/2015 Park ..... G09G 3/3225 345/691
2015/0346817 A1 * 12/2015 Gallo ..... G09G 5/02 345/619
2020/0074596 A1 * 3/2020 Chun ..... G09G 3/2007
2020/0074708 A1 * 3/2020 Park ..... G06T 7/90
2020/0372860 A1 * 11/2020 Kim ..... H04N 5/57
2022/0366853 A1 * 11/2022 Kwon ..... G09G 3/3258

FOREIGN PATENT DOCUMENTS

KR 10-2021-0157525 A 12/2021

* cited by examiner

*Primary Examiner* — Rodney Amadiz
(74) *Attorney, Agent, or Firm* — Lewis Roca Rothgerber Christie LLP

(57) ABSTRACT

An afterimage compensation device includes: an afterimage area detector to receive an input image, and detect an afterimage area including an afterimage in the input image; an afterimage area corrector to detect a false detection area, and generate a corrected afterimage area, the false detection area being a part of a general area that is not detected as the afterimage area and surrounded in a plurality of directions by the detected afterimage area; and a compensation data generator to adjust a luminance of the corrected afterimage area to generate compensation data.

20 Claims, 12 Drawing Sheets

AFTERIMAGE COMPENSATION DEVICE AND DISPLAY DEVICE INCLUDING THE SAME

CROSS-REFERENCE TO RELATED APPLICATION

This application claims priority to and the benefit of Korean Patent Application No. 10-2020-0132512, filed on Oct. 14, 2020, in the Korean Intellectual Property Office, the disclosure of which is incorporated by reference in its entirety herein.

BACKGROUND

1. Field

Aspects of one or more embodiments of the present disclosure relate to an afterimage compensation device, and a display device including the same.

2. Description of the Related Art

When a display device displays a video having a fixed image (e.g., a still image) for a considerable period of time, an afterimage may occur. When a display device displays a video having a fixed image (e.g., a still image) for a considerable period of time, and then displays a video not having a fixed image, spots may be displayed in an area where the fixed image was displayed. Accordingly, when an afterimage occurs in the display device, display quality thereof may be deteriorated.

The above information disclosed in this Background section is for enhancement of understanding of the background of the present disclosure, and therefore, it may contain information that does not constitute prior art.

SUMMARY

One or more embodiments of the present disclosure are directed to an afterimage compensation device in which a detected afterimage area may be corrected to set an afterimage area closer to an actual afterimage area, and luminance of the corrected afterimage area may be adjusted, thereby preventing or reducing the occurrence of an afterimage, reducing a color shift, and/or improving a display quality, and a display device including the after image compensation device.

However, the aspects and features of the present disclosure are not limited to the ones set forth herein. The above and other aspects and features of the present disclosure will become more apparent to one of ordinary skill in the art to which the present disclosure pertains by referencing the detailed description and the drawings of the present disclosure.

According to one or more embodiments of the present disclosure, an afterimage compensation device includes: an afterimage area detector configured to receive an input image, and detect an afterimage area including an afterimage in the input image; an afterimage area corrector configured to detect a false detection area, and generate a corrected afterimage area, the false detection area being a part of a general area that is not detected as the afterimage area and surrounded in a plurality of directions by the detected afterimage area; and a compensation data generator configured to adjust a luminance of the corrected afterimage area to generate compensation data.

In an embodiment, the afterimage area corrector may be configured to determine an area that is surrounded in at least three directions from among an upward direction, a downward direction, a left direction, and a right direction by the afterimage area in which the part of the general area is detected as the false detection area.

In an embodiment, the afterimage area corrector may be configured to determine an area in which a boundary surface of the part of the general area has a radius of curvature lower than a preset radius of curvature as the false detection area.

In an embodiment, the afterimage area corrector may be configured to determine the part of the general area as the false detection area when a size or a number of pixels of the part of the general area surrounded by the detected afterimage area is smaller than a preset size or number of pixels.

In an embodiment, the afterimage area detector may be configured to receive a plurality of example images, and detect an afterimage area of each of the plurality of example images, and the afterimage area corrector may be configured to receive a designated false detection area designated based on the afterimage area of each of the plurality of example images, and cluster a pixel size of the designated false detection area to store a plurality of clusters according to a result of the clustering.

In an embodiment, the afterimage area corrector may be configured to calculate a median value of the pixel size based on the plurality of clusters, and the afterimage area corrector may be configured to determine an area between the afterimage areas detected from the input image as the false detection area when a distance between the afterimage areas detected from the input image is equal to or less than the median value of the pixel size.

In an embodiment, the afterimage area corrector may be configured to calculate a median value of the pixel size based on the plurality of clusters, and the afterimage area corrector may be configured to determine an area between the detected afterimage areas as the general area when a distance between the afterimage areas detected from the input image is more than the median value of the pixel size.

In an embodiment, the afterimage area corrector may be configured to correct an area extended from a boundary of the after image detected from the afterimage area detector by a preset pixel size as the corrected afterimage area.

In an embodiment, the afterimage area corrector may be configured to determine a pixel size of the extended area in a corresponding direction based on a length of the detected afterimage area in the corresponding direction.

In an embodiment, the pixel size of the extended area in the corresponding direction may be proportional to the length of the detected afterimage area in the corresponding direction, may be proportional to a log value of the length of the detected afterimage area in the corresponding direction, or maybe proportional to an n square root of the length of the detected afterimage area in the corresponding direction, where n may be a natural number of 2 or more.

In an embodiment, the compensation data generator may be configured to reduce a luminance of the general area adjacent to the corrected afterimage area as a distance from the corrected afterimage area increases.

In an embodiment, the compensation data generator may be configured to uniformly apply a luminance gain of the corrected afterimage area, and reduce a luminance gain of the general area as a distance from the corrected afterimage area increases.

In an embodiment, a magnitude of a derivative of the luminance gain of the general area may increase as a distance from the corrected afterimage area increases, may reach a maximum value at a specific point, and may decrease as a distance from the corrected afterimage area and the specific point increases.

According to one or more embodiments of the present disclosure, an afterimage compensation device includes: an afterimage area detector configured to receive an input image, and detect an afterimage area including an afterimage in the input image; an afterimage area corrector configured to correct an area extended from a boundary of the detected afterimage area by a preset pixel size as a corrected afterimage area; and a compensation data generator configured to adjust a luminance of the corrected afterimage area to generate compensation data. The afterimage area corrector is configured to determine a pixel size of the extended area in a corresponding direction based on a length of the detected afterimage area in the corresponding direction.

In an embodiment, the pixel size of the extended area in the corresponding direction may be proportional to the length of the detected afterimage area in the corresponding direction, may be proportional to a log value of the length of the detected afterimage area in the corresponding direction, or may be proportional to an n square root of the length of the detected afterimage area in the corresponding direction, where n may be a natural number of 2 or more.

In an embodiment, the compensation data generator may be configured to uniformly apply a luminance gain of the corrected afterimage area, and reduce a luminance gain of the general area as a distance from the corrected afterimage area increases.

In an embodiment, a magnitude of a derivative of the luminance gain of the general area may increase as a distance from the corrected afterimage area increases, may reach a maximum value at a specific point, and may decrease as a distance from the corrected afterimage area and the specific point increases.

According to one or more embodiments of the present disclosure, a display device includes: an afterimage compensation device configured to detect an afterimage area from an input image, correct the detected afterimage area to generate a corrected afterimage area, and output compensation data applied to the corrected afterimage area; a timing controller configured to generate pixel data based on the compensation data; and a display panel configured to display an image based on the pixel data. The afterimage compensation device includes: an afterimage area detector configured to receive the input image, and detect the afterimage area including an afterimage in the input image; an afterimage area corrector configured to detect a false detection area, and generate the corrected afterimage area, the false detection area being in a part of a general area not detected as the afterimage area and surrounded in a plurality of directions by the detected afterimage area; and a compensation data generator configured to adjust a luminance of the corrected afterimage area to generate the compensation data.

In an embodiment, the afterimage area detector may be configured to receive a plurality of example images, and detect an afterimage area of each of the plurality of example images, and the afterimage area corrector may be configured to receive a designated false detection area designated based on the afterimage area of each of the plurality of example images, calculate a median value of a pixel size based on a plurality of clusters obtained by clustering the pixel size of the false detection area, and detect the false detection area based on the median value of the pixel size.

In an embodiment, the afterimage area corrector may be configured to correct an area extended from a boundary of the afterimage area detected from the afterimage area detector by a preset pixel size as the corrected afterimage area.

BRIEF DESCRIPTION OF THE DRAWINGS

The above and other aspects and features of the present disclosure will be more clearly understood from the following detailed description of the illustrative, non-limiting example embodiments with reference to the accompanying drawings, in which.

DETAILED DESCRIPTION

Figure 1:
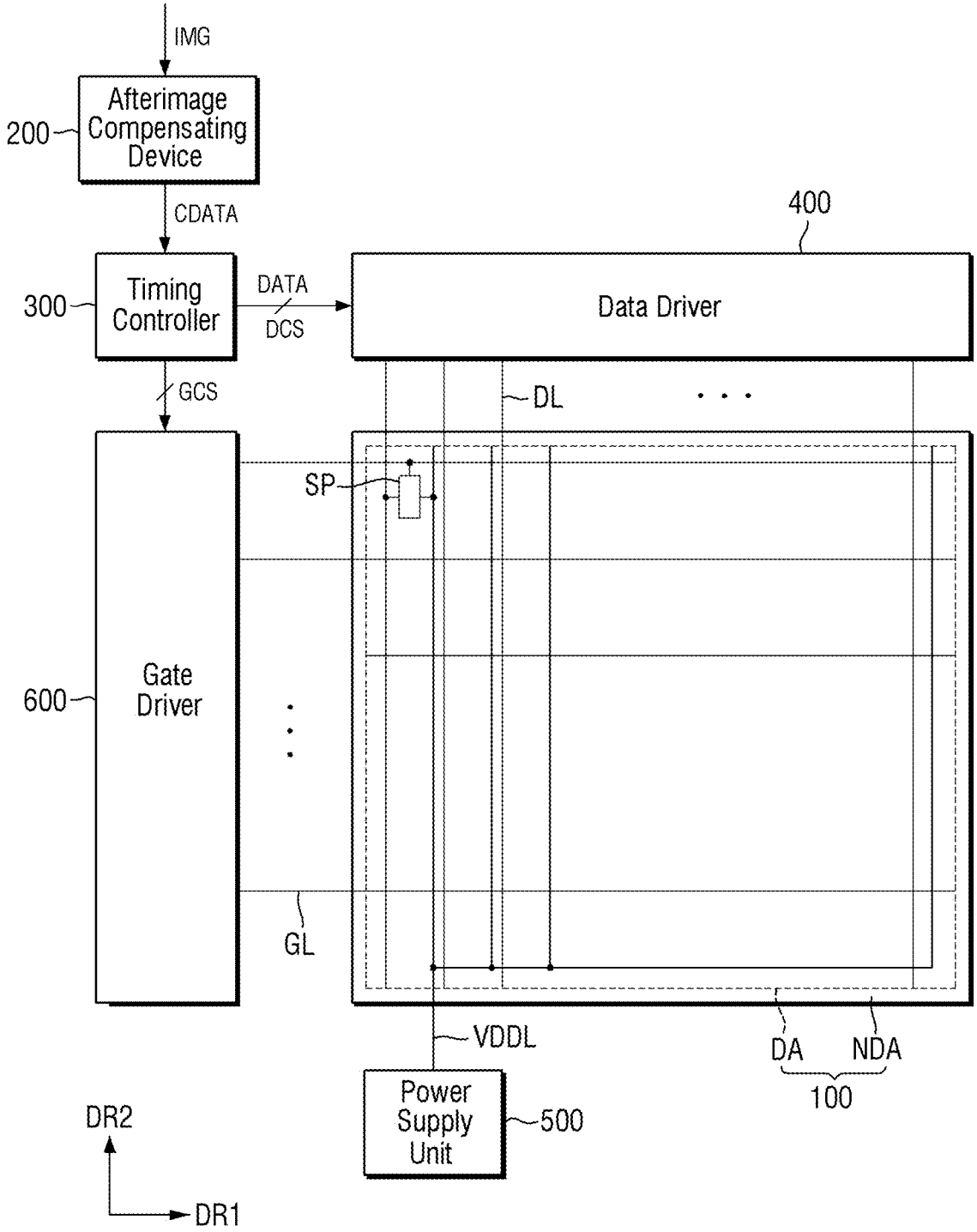
FIG. 1 is a block diagram of a display device according to an embodiment.

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. For example, known structures and devices may be shown in block diagram form in order to avoid unnecessarily obscuring the aspects and features of various embodiments. Unless otherwise noted, like reference numerals denote like elements throughout the attached drawings and the written description, and thus, descriptions thereof may not be repeated.

Unless otherwise specified, the illustrated embodiments are to be understood as providing some example features of varying detail of some ways in which the presented embodiments may be implemented in practice. Therefore, unless otherwise specified, the features, components, modules, layers, films, panels, regions, aspects, and/or the like (hereinafter individually or collectively referred to as "elements"), of the various presented embodiments may be otherwise combined, separated, interchanged, and/or rearranged without departing from the spirit and scope of the present disclosure.

When a certain embodiment may be implemented differently, a specific process order may be different from the described order. For example, two consecutively described processes may be performed at the same or substantially at the same time, or may be performed in an order opposite to the described order.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

The use of cross-hatching and/or shading in the accompanying drawings are generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, and/or the like, of the elements illustrated, unless otherwise specified.

Various embodiments are described herein with reference to sectional and/or exploded illustrations that are schematic illustrations of idealized embodiments and/or intermediate structures. As such, variations from the shapes of the illustrations as a result, for example, of manufacturing techniques and/or tolerances, are to be expected. Thus, embodiments disclosed herein should not necessarily be construed as limited to the particular illustrated shapes of regions, but are to include deviations and/or variations in the shapes that result from, for example, manufacturing processes thereof. In this manner, regions illustrated in the drawings may be schematic in nature and the shapes of these regions may not reflect actual shapes of the regions of a device, and as such, are not necessarily intended to be limiting.

In the figures, the x-axis, the y-axis, and the z-axis are not limited to three axes of the rectangular coordinate system, and may be interpreted in a broader sense. For example, the x-axis, the y-axis, and the z-axis may be perpendicular to or substantially perpendicular to one another, or may represent different directions from each other that are not perpendicular to one another.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. Similarly, when a layer, an area, or an element is referred to as being "electrically connected" to another layer, area, or element, it may be directly electrically connected to the other layer, area, or element, and/or may be indirectly electrically connected with one or more intervening layers, areas, or elements therebetween. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. For example, the expression "A and/or B" denotes A, B, or A and B. Expressions such as "at least one of" and "at least one selected from the group consisting of" when preceding a list of elements, modify the entire list of elements and do not modify the individual elements of the list. For example, the expressions "at least one of a, b, or c," "at least one of a, b, and c," and "at least one selected from the group consisting of a, b, and c" indicate only a, only b, only c, both a and b, both a and c, both b and c, all of a, b, and c, or variations thereof.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration. As used herein "embodiments" and "implementations" are interchangeable terms that refer to non-limiting examples of devices or methods employing one or more of the presented embodiments disclosed herein.

As is customary in the field, some embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein, and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some embodiments may be physically separated into two or more interacting and discrete blocks, units, and/or modules without departing from the spirit and scope of the present disclosure. Further, the blocks, units, and/or modules of some embodiments may be physically combined into more complex blocks, units, and/or modules without departing from the spirit and scope of the present disclosure.

The electronic or electric devices (e.g., afterimage compensating device) and/or any other relevant devices or components (e.g., after image detection unit, afterimage area correction unit, compensation data generating unit, and the like) according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present disclosure.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram of a display device according to an embodiment.

Referring to FIG. 1, the display device, which is a device for displaying a moving image and/or a still image, may be used as a display screen of various suitable products, for example, such as televisions, notebooks, monitors, billboards, internet of things (IOTs) devices, and/or the like, as well as for various suitable portable electronic appliances, for example, such as mobile phones, smart phones, tablet personal computers (tablet PCs), smart watches, watch phones, mobile communication terminals, electronic notebooks, electronic books, portable multimedia players (PMPs), navigators, ultra-mobile PCs (UMPCs), and/or the like.

The display device may include a display panel 100, an afterimage compensation device 200, a timing controller 300, a data driver 400, a power supply unit (e.g., a power supply, a power supply device, or a power supply circuit) 500, and a gate driver 600.

The display panel 100 may have a rectangular shape in a plan view (e.g., in a view from a direction that is perpendicular to or substantially perpendicular to a top surface of the relevant element, layer, or device, for example, such as the top surface of the display panel 100). For example, the display panel 100 may have a rectangular planar shape having long sides extending in the first direction DR1, and short sides extending in the second direction DR2, which is perpendicular to or substantially perpendicular to the first direction DR1. A corner where the long side extending in the first direction DR1 meets the short side extending in the second direction DR2 may be formed to have a right-angled shape, or a rounded shape having a suitable curvature (e.g., a predetermined curvature). The planar shape of the display panel 100 is not limited to the rectangular shape, and may be formed in another suitable polygonal shape, a circular shape, an elliptical shape, or the like. For example, the display panel 100 may be formed to be flat or substantially flat, but the present disclosure is not limited thereto. As another example, the display panel 100 may be formed to be bent at a suitable curvature (e.g., a predetermined curvature).

The display panel 100 may include a display area DA, and a non-display area NDA. The non-display NDA area may be adjacent to the display area DA. For example, the non-display area NDA may at least partially surround (e.g., around a periphery of) the display area DA.

The display area DA, which is an area for displaying an image, may be defined as a central area of a first substrate 110 of the display panel 100. The display area DA may include a plurality of pixels SP formed for each pixel area intersected by (e.g., crossed by) a plurality of data lines DL and a plurality of gate lines GL. Each of the plurality of pixels SP may be connected to at least one gate line GL, at least one data line DL, and a driving voltage line VDDL. Each of the plurality of pixels SP may be defined as an area of a minimum unit for outputting light.

The plurality of data lines DL may be connected between the data driver 400 and the plurality of pixels SP. The plurality of data lines DL may supply data voltages to the plurality of pixels SP, respectively. The plurality of data lines DL may be spaced apart from each other along the first direction DR1, and may extend in the second direction DR2.

The plurality of gate lines GL may be connected between the gate driver 600 and the plurality of pixels SP. The plurality of gate lines GL may supply gate signals to the plurality of pixels SP, respectively. The plurality of gate lines GL may extend in the first direction DR1, and may be spaced apart from each other along the second direction DR2.

The non-display area NDA may be defined as the remaining area of the display panel 100 other than the display area DA. For example, the non-display area NDA may include the gate driver 600 for applying the gate signals to the gate lines GL, fan-out lines connecting the data lines DL with the data driver 400, and a pad unit (e.g., a pad area or a pad terminal area) connected to a flexible film.

The afterimage compensation device 200 may receive an input image IMG, and may detect an afterimage area of the input image IMG. The afterimage compensation device 200 may generate compensation data CDATA by adjusting a luminance of the afterimage area. The afterimage compensation device 200 may receive gradation data of the input image IMG in a frame unit (e.g., in a unit of a frame). For example, the afterimage compensation device 200 may analyze the gradation data of the input image IMG by using a histogram, and may classify a general area and an afterimage area based on a difference value in the histogram. For another example, the afterimage compensation device 200 may classify a general area and an afterimage area based on a color hue, a color saturation, and a color value of the gradation data of the input image IMG. The afterimage area of the input image IMG may be generated (e.g., may be identified) as an area where the input image IMG has a fixed image (e.g., a still image) for a considerable period of time.

When the detected afterimage area has a difference from an actual afterimage area, the afterimage compensation device 200 may correct the detected afterimage area. For example, the afterimage compensation device 200 may determine a part of the general area as a false detection area, and may correct the false detection area as an afterimage area to generate a corrected afterimage area. The afterimage compensation device 200 may generate the compensation data CDATA by adjusting the luminance of the corrected afterimage area, and may provide the compensation data CDATA to the timing controller 300.

For example, the afterimage compensation device 200 may be implemented as a separate chip (e.g., a separate integrated circuit (IC) chip) from that of the timing controller 300. For another example, the afterimage compensation device 200 and the timing controller 300 may be implemented together as a single chip (e.g., a single IC chip).

The timing controller 300 may receive a timing synchronization signal from a display driving system, and may receive the compensation data CDATA from the afterimage compensation device 200. The timing controller 300 may generate a data control signal DCS and a gate control signal GCS based on the timing synchronization signal. The timing controller 300 may control the driving timing of the data driver 400 using the data control signal DCS, and may control the driving timing of the gate driver 600 using the gate control signal GCS.

The timing controller 300 may generate pixel data DATA based on the compensation data CDATA, and may align the pixel data DATA to be suitable for an arrangement structure of the pixels SP to supply the aligned pixel data DATA to the data driver 400. The timing controller 300 supplies the pixel data DATA, in which the compensation data CDATA is reflected, to the data driver 400, so that the display device may prevent or substantially prevent the occurrence of an afterimage, and the display quality thereof may be improved.

The data driver 400 may receive the pixel data DATA and the data control signal DCS from the timing controller 300. The data driver 400 may generate a data voltage based on the pixel data DATA, and may supply the data voltage to the data line DL according to the data control signal DCS. The data voltage may be supplied to a plurality of the pixels SP through the data line DL, and may determine the luminance of the plurality of the pixels SP.

The power supply unit 500 may supply a driving voltage to the display panel 100. The power supply unit 500 may generate the driving voltage, and may supply the driving voltage to the plurality of pixels SP arranged on the display panel 100 through the driving voltage line VDDL. The power supply unit 500 may generate a common voltage, and may supply the common voltage to a low-potential line of the display panel 100. For example, the driving voltage may correspond to a high-potential voltage capable of driving the plurality of pixels SP, and the common voltage may correspond to a low-potential voltage that is commonly supplied to the plurality of pixels SP.

The gate driver 600 may be provided at (e.g., in or on) the non-display area NDA of the display panel 100. The gate driver 600 may generate a gate signal based on the gate control signal GCS supplied from the timing controller 300, and may supply (e.g., may sequentially supply) the gate signal to the plurality of gate lines GL according to a suitable order (e.g., a preset or predetermined order).

Figure 2:
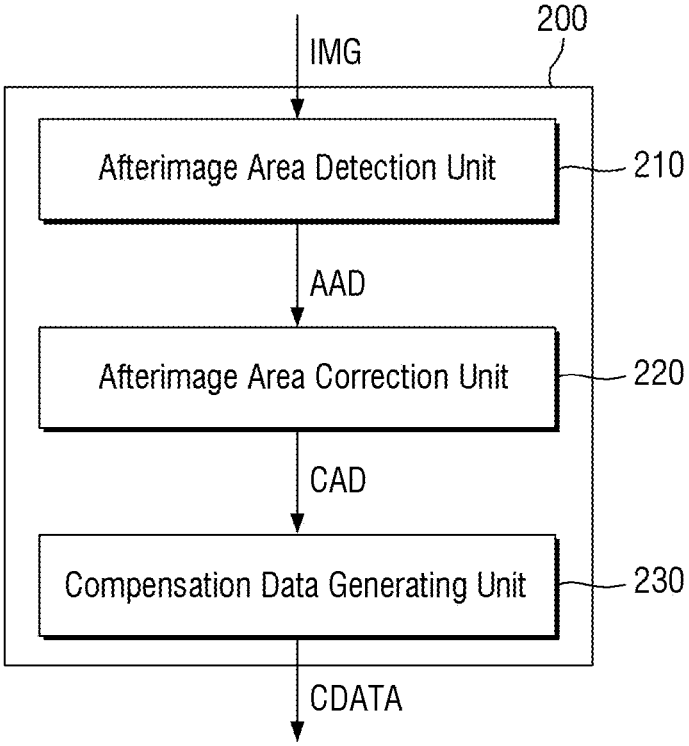
FIG. 2 is a block diagram illustrating an afterimage compensation device of a display device according to an embodiment.

FIG. 2 is a block diagram illustrating an afterimage compensation device of a display device according to an embodiment.

Referring to FIG. 2, the afterimage compensation device 200 may include an afterimage area detection unit (e.g., an afterimage area detector) 210, an afterimage area correction unit (e.g., an after image area corrector) 220, and a compensation data generation unit (e.g., a compensation data generator) 230.

The afterimage area detection unit 210 may receive the input image IMG, and may detect the afterimage area including an afterimage in the input image IMG. The afterimage area of the input image IMG may be generated when the input image IMG has the fixed image for a considerable period of time. The afterimage area detection unit 210 may receive the gradation data of the input image IMG in the frame unit. For example, the afterimage area detection unit 210 may analyze the gradation data of the input image IMG by using a histogram, and may classify a general area and the afterimage area based on a difference value in the histogram. For another example, the afterimage area detection unit 210 may classify the general area and the afterimage area based on the color hue, the color saturation, and the color value of the gradation data of the input image IMG. The afterimage area detection method of the afterimage area detection unit 210 is not limited to the above-described method, and the afterimage area detection unit 210 may distinguish an image (e.g., a still image) that is fixed during a plurality of frames from an image (e.g., a moving image) that changes every frame from the input image IMG using any suitable method. The afterimage area detection unit 210 may provide afterimage area data AAD including information of the detected afterimage area (e.g., detected afterimage area information) to the afterimage area correction unit 220.

The afterimage area correction unit 220 may detect a false detection area, and may correct the false detection area as a corrected afterimage area. The false detection area may correspond to an area surrounded (e.g., around a periphery thereof) in a plurality of directions by the detected afterimage area at (e.g., in or on) a part of the general area that is not detected as the afterimage area. For example, the afterimage area correction unit 220 may determine an area surrounded in at least three directions from among an upward direction, a downward direction, a left direction, and a right direction by the afterimage area, in which a part of the general area is detected as the false detection area. For another example, the afterimage area correction unit 220 may determine an area in which a boundary surface of a part of the general area has a radius of curvature that is lower than a suitable radius of curvature (e.g., a predetermined or preset radius of curvature) as the false detection area. For another example, when the size or number of pixels of a part of the general area that is surrounded (e.g., around a periphery thereof) by the detected afterimage area is smaller than a suitable size or number (e.g., a predetermined or preset size or number) of pixels, the afterimage area correction unit 220 may determine the corresponding area as the false detection area. When the size or number of pixels of the part of the general area surrounded by the detected afterimage area is greater than the suitable size or number (e.g., the predetermined or preset size or number) of pixels, the afterimage area correction unit 220 may determine that the corresponding area should be a part of the genera area, and not the false detection area. The afterimage area correction unit 220 may correct the false detection area as the corrected afterimage area, and may provide corrected afterimage area data CAD including information of the corrected afterimage area (e.g., corrected afterimage area information) to the compensation data generation unit 230.

The afterimage area correction unit 220 may correct an area extended from the boundary of the afterimage area by a suitable pixel size (e.g., a predetermined pixel size) as the corrected afterimage area. The afterimage area correction unit 220 may determine a pixel size of the extended area in a corresponding direction (e.g., in a specific direction) based on the length of the detected afterimage area in the corresponding direction. For example, the afterimage area correction unit 220 may determine the pixel size of the extended area in the first direction DR1 based on the length of the detected afterimage area in the first direction DR1.

The compensation data generation unit 230 may generate compensation data CDATA by adjusting a luminance of the corrected afterimage area. For example, the compensation data generation unit 230 may reduce the luminance of the corrected afterimage area by setting (e.g., by changing) a luminance gain of the corrected afterimage area to be less than 1. The compensation data generation unit 230 may provide the compensation data CDATA to the timing controller 300. The compensation data generation unit 230 may prevent or reduce the occurrence of an afterimage in the display device, may reduce a color shift, and may improve a display quality by adjusting the luminance of the corrected afterimage area and/or a luminance of a general area around (e.g., surrounding around a periphery of) the corrected afterimage area.

Figure 3:
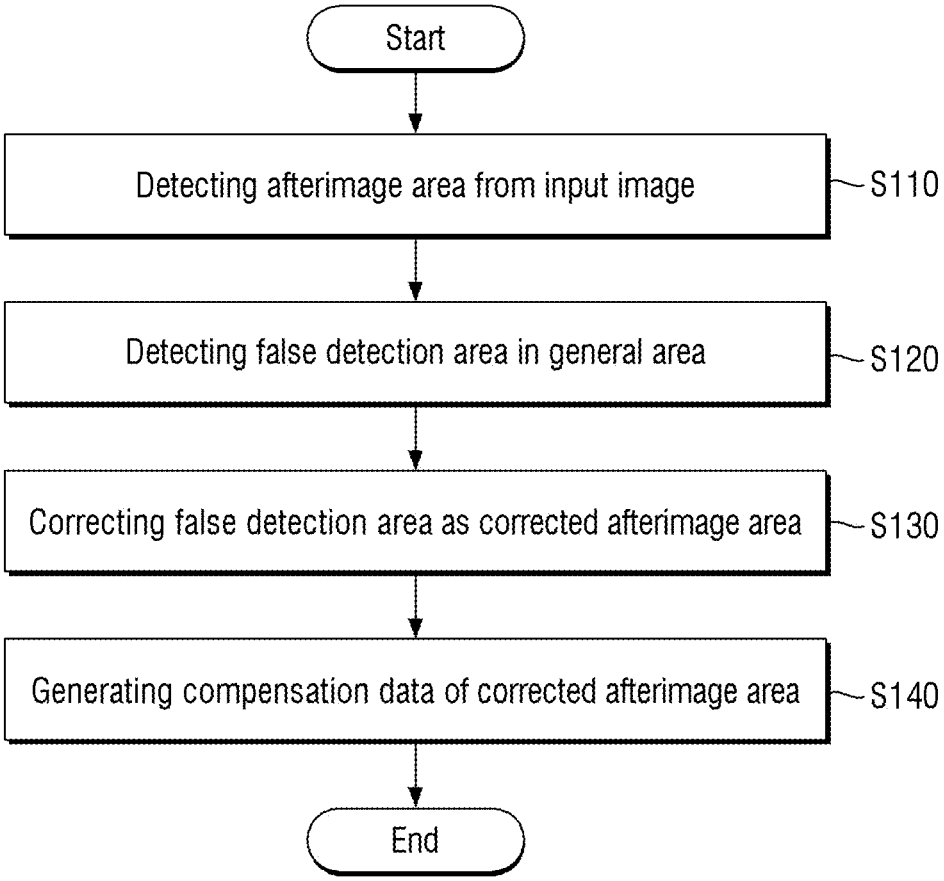
FIG. 3 is a flowchart illustrating an afterimage compensating process of an afterimage compensation device according to an embodiment.

FIG. 3 is a flowchart illustrating an afterimage compensating process of an afterimage compensation device according to an embodiment.

Referring to FIG. 3, the afterimage compensation device 200 may include the afterimage area detection unit 210, the afterimage area correction unit 220, and the compensation data generation unit 230.

The afterimage area detection unit 210 may receive the input image IMG, and may detect the afterimage area including the afterimage in the input image IMG (block S110). The afterimage area detection unit 210 may distinguish an image (e.g., a still image) that is fixed during a plurality of frames from an image (e.g., a moving image) that changes every frame from the input image IMG. The afterimage area detection unit 210 may provide the afterimage area data AAD including the detected afterimage area information to the afterimage area correction unit 220.

The afterimage area correction unit 220 may detect the false detection area in the general area (block S120). For example, the afterimage area correction unit 220 may determine an area that is surrounded (e.g., around a periphery thereof) in at least three directions from among the upward direction, the downward direction, the left direction, and the right direction by the afterimage area in which a part of the general area is detected as the false detection area. For another example, the afterimage area correction unit 220 may determine an area in which a boundary surface of a part of the general area has a radius of curvature lower than the suitable radius of curvature (e.g., the predetermined or preset radius of curvature) as the false detection area. For another example, when the size or number of pixels of a part of the general area surrounded by the detected afterimage area is smaller than the suitable size or number (e.g., the predetermined or preset size or number) of pixels, the afterimage area correction unit 220 may determine the corresponding area as the false detection area.

The afterimage area correction unit 220 may correct the false detection area as the corrected afterimage area (block S130). The afterimage area correction unit 220 may provide the corrected afterimage area data CAD including the corrected afterimage area information to the compensation data generation unit 230.

The compensation data generation unit 230 may generate the compensation data CDATA of the corrected afterimage area (block S140). The compensation data generation unit 230 may generate the compensation data CDATA by adjusting the luminance of the corrected afterimage area. For example, the compensation data generation unit 230 may reduce the luminance of the corrected afterimage area by setting (e.g., by changing) the luminance gain of the corrected afterimage area to less than 1. The compensation data generation unit 230 may provide the compensation data CDATA to the timing controller 300.

Figure 4:
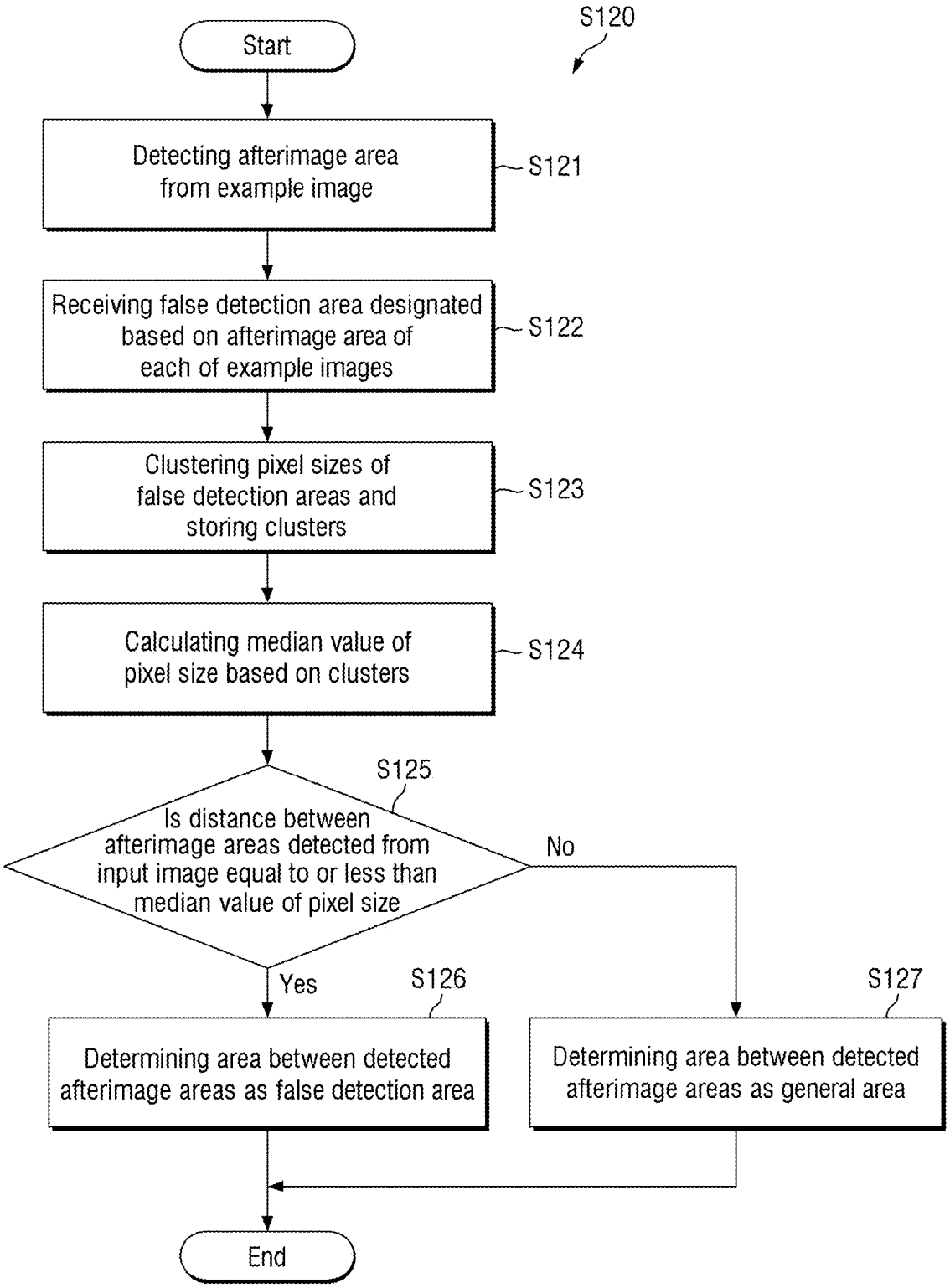
FIG. 4 is a flowchart illustrating a process of detecting a false detection area in an afterimage compensation process according to an embodiment.

FIG. 4 is a flowchart illustrating a process of detecting a false detection area in an afterimage compensation process according to an embodiment.

Referring to FIG. 4, in the block (S120) of detecting the false detection area, the false detection area of the input image IMG may be detected based on a plurality of clusters extracted from a plurality of example images.

The afterimage area detection unit 210 may receive the plurality of example images, and may detect an afterimage area from each of the plurality of example images (block S121). The afterimage area detection unit 210 may provide the afterimage area data AAD including the detected afterimage area information to the afterimage area correction unit 220.

A designer or manufacturer of the afterimage compensation device 200 may designate at least one false detection area of the example image based on the afterimage area data AAD. The afterimage area correction unit 220 may receive the false detection area designated based on the afterimage area of each of the plurality of example images (block S122). Each of the plurality of example images may include at least one false detection area, and the afterimage area correction unit 220 may receive a plurality of false detection areas. For example, the afterimage area correction unit 220 may include a storage module (e.g., a storage device, a storage system, or a data store), for example, such as a database, and may store a plurality of false detection areas of a plurality of example images.

The afterimage area correction unit 220 may cluster the pixel sizes of each of the plurality of false detection areas stored in the storage module to store a plurality of clusters (block S123). Here, the pixel size may correspond to the number of pixels in the first direction DR1 and the number of pixels in the second direction DR2 at (e.g., in or on) the corresponding area, but the present disclosure is not limited thereto. For another example, the pixel size may correspond to the number of pixels in a direction other than the first direction DR1 and the second direction DR2. For another example, the pixel size may correspond to the number of pixels that are concentrated at (e.g., in or on) one area irrespective of the direction. Accordingly, the size of the cluster may refer to an area of the corresponding false detection area, or the pixel size of the corresponding false detection area.

The size of the cluster may be proportional to a resolution. For example, because the number of pixels arranged in a unit area increases as the resolution increases, the size of the cluster may increase as the resolution increases.

The afterimage area correction unit 220 may calculate a median value of the pixel size based on the plurality of clusters (block S124). For example, the median value of the pixel size may be calculated through a statistical method based on the plurality of clusters, but the present disclosure is not limited thereto. The median value of the pixel size may be a criterion for classifying the false detection area and the general area.

The process of calculating the median value of the pixel size by detecting the afterimage area from the plurality of example images, and extracting the plurality of clusters from the detected afterimage area may be a preparation process of the process of detecting the afterimage area and the false detection area from the input image IMG. Accordingly, the blocks S121, S122, S123, and S124 may be preceded (e.g., may be temporally preceded) by the block S110 of detecting the afterimage area from the input image IMG of FIG. 3. The block S120 of detecting the false detection area shown in FIG. 4 may correspond to an example of some processes included in the block S120 of detecting the false detection area of FIG. 3. Accordingly, the block S120 of detecting the false detection area of FIG. 3 is not limited to the illustration shown in FIG. 4.

The afterimage area correction unit 220 may compare the distance between the afterimage areas detected from the input image IMG with the median value of the pixel size (block S125). For example, the afterimage area correction unit 220 may compare the distance in the first direction DR1 and the distance in the second direction DR2 between the detected afterimage areas with the median value of the pixel size. The afterimage area correction unit 220 may compare the area or the pixel size of a part of the general area surrounded by the detected afterimage area with the median value of the pixel size calculated from the plurality of clusters.

When the distance between the afterimage areas detected from the input image IMG is equal to or less than the median value of the pixel size (e.g., YES at block S125), the afterimage area correction unit 220 may determine the area between the detected afterimage images as the false detection area (block S126). The afterimage area correction unit 220 may determine a part of the corresponding general area as the false detection area when the area or the pixel size of the part of the general area surrounded by the detected afterimage area is less than or equal to the median value of the pixel size. The afterimage area correction unit 220 may correct the false detection area as the corrected afterimage area, and may provide the corrected afterimage area data CAD including the corrected afterimage area information to the compensation data generation unit 230.

When the distance between the afterimage areas detected from the input image IMG is greater than (e.g., is more than) the median value of the pixel size (e.g., NO at block S125), the afterimage area correction unit 220 may determine the area between the detected afterimage images as a general area (block S127). For example, the general area that is not close to (e.g., that is not near or that is not adjacent to) the corrected afterimage area may be excluded from the luminance adjustment.

Figure 5:
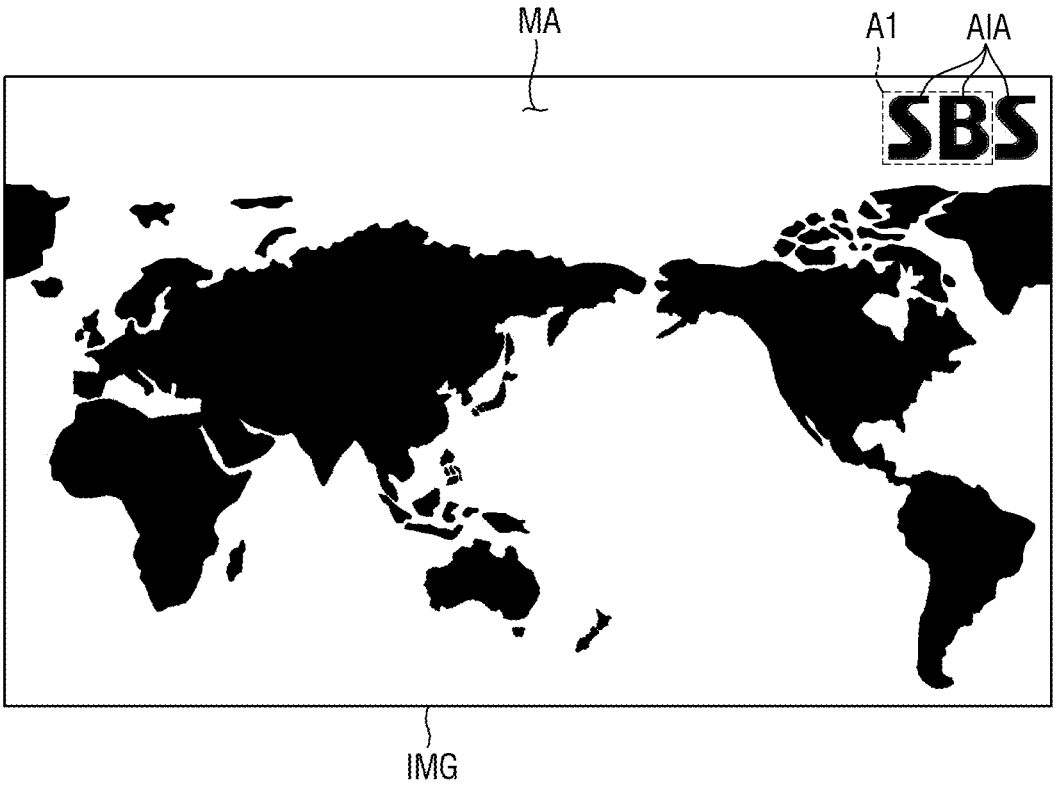
FIG. 5 is a view illustrating an input image of an afterimage compensation device according to an embodiment.
Figure 6:
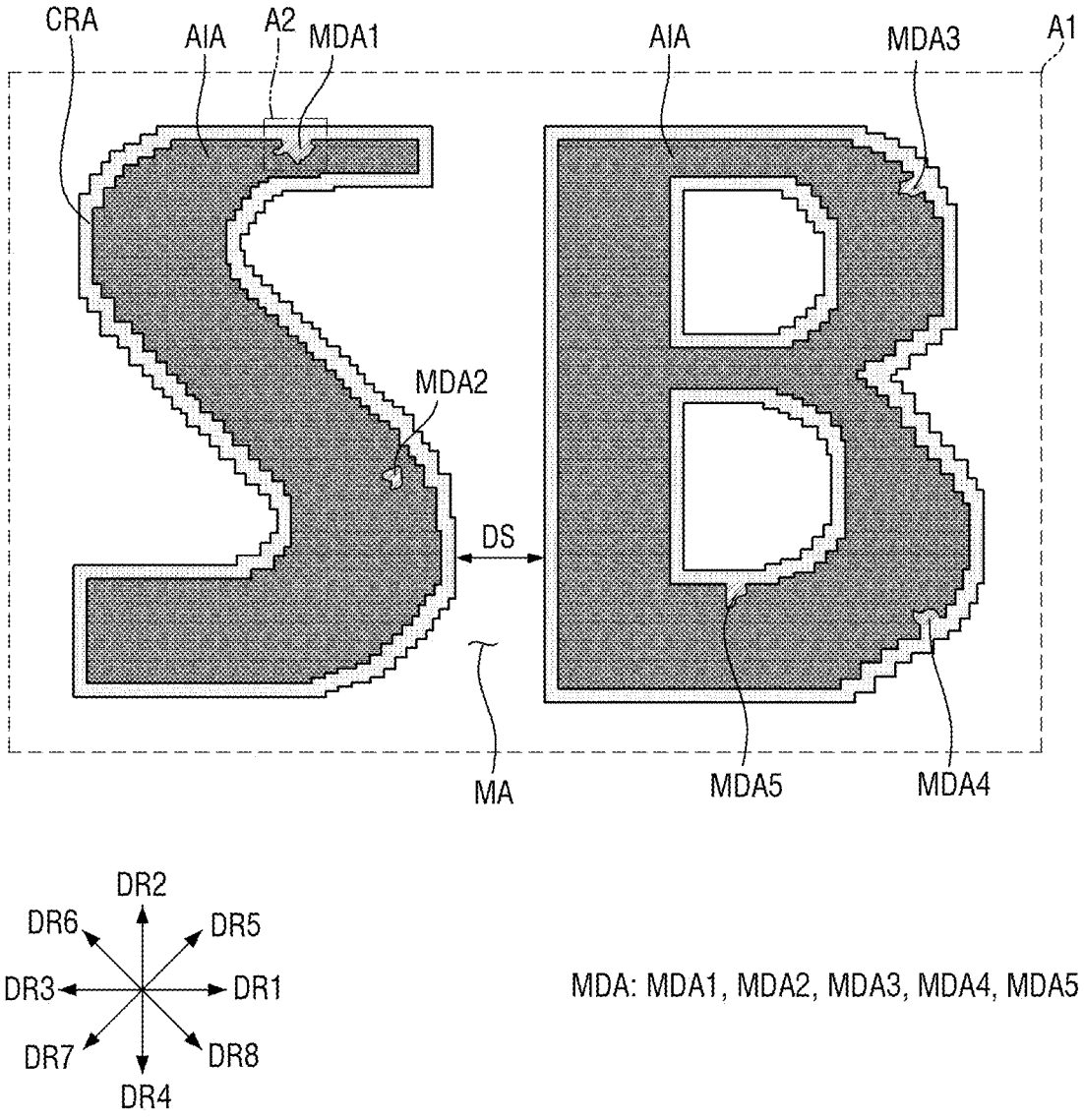
FIG. 6 is an enlarged view of the area A1 in FIG. 5, which illustrates a false detection area.
Figure 7:
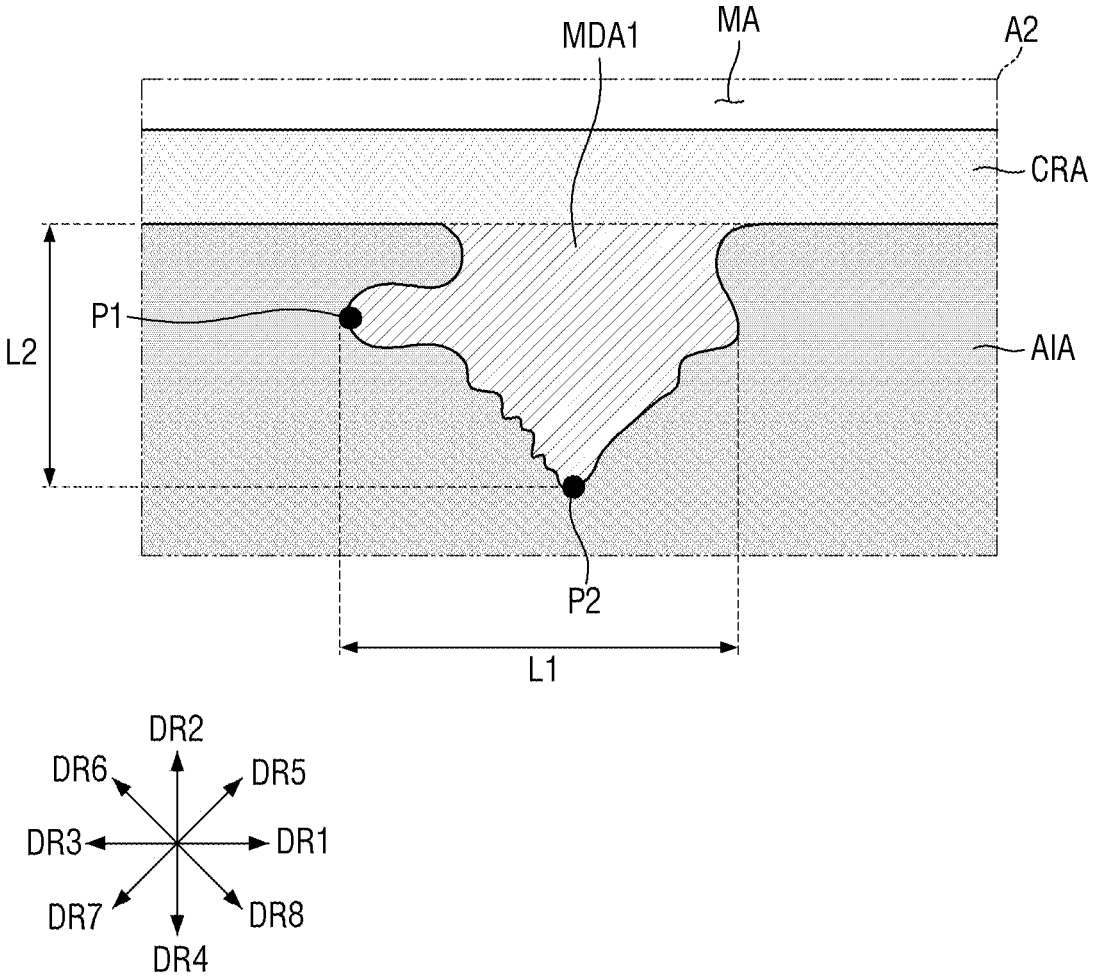
FIG. 7 is an enlarged view of the area A2 in FIG. 6, which illustrates a pixel size of a false detection area.

FIG. 5 is a view illustrating an input image of an afterimage compensation device according to an embodiment. FIG. 6 is an enlarged view of the area A1 in FIG. 5, which illustrates a false detection area. FIG. 7 is an enlarged view of the area A2 in FIG. 6, which illustrates the pixel size of a false detection area.

Referring to FIGS. 5 to 7, the afterimage compensation device 200 may receive the input image IMG to detect the afterimage area of the input image IMG, and may adjust the luminance of the afterimage area to generate the compensation data CDATA. When the detected afterimage area AIA has a difference from an actual afterimage area CRA, the afterimage compensation device 200 may correct the detected afterimage area AIA.

The afterimage area detection unit 210 may receive the input image IMG to detect a general area MA not including the afterimage, and the afterimage area AIA including the afterimage.

The afterimage area correction unit 220 may detect a false detection area MDA, and may correct the false detection area MDA as the corrected afterimage area. The false detection area MDA may correspond to an area surrounded (e.g., around a periphery thereof) in a plurality of directions by the detected afterimage area AIA in a part of the general area MA that is not detected as the afterimage area AIA.

The afterimage area correction unit 220 may determine an area surrounded in at least three directions from among the upward direction, the downward direction, the left direction, and the right direction by the afterimage area AIA in which a part of the general area is detected as the false detection area MDA.

As shown in FIG. 6, a first false detection area MDA1 may be surrounded (e.g., around a periphery thereof) by the detected afterimage area AIA in at least the first direction DR1, the third direction DR3, and the fourth direction DR4. A second false detection area MDA2 may be surrounded (e.g., around a periphery thereof) by the detected afterimage area AIA in the first to eighth directions DR1 to DR8. Accordingly, the afterimage area correction unit 220 may detect the first to fifth false detection areas MDA1 to MDAS, and may correct them as the corrected afterimage area.

The afterimage area correction unit 220 may determine an area in which a boundary surface of a part of the general area MA has a radius of curvature lower than a suitable radius of curvature (e.g., a predetermined or preset radius of curvature) as the false detection area MDA. As shown in FIG. 7, the radius of curvature of the boundary surface including a first point P1 of the first false detection area MDA1 may be lower than the suitable radius of curvature (e.g., the predetermined or preset radius of curvature). The radius of curvature of the boundary surface including a second point P2 of the first false detection area MDA1 may be lower than the suitable radius of curvature (e.g., the predetermined or preset radius of curvature). Accordingly, the afterimage area correction unit 220 may detect the first false detection area MDA1, and may correct the first false detection area MDA1 as the corrected afterimage area.

When the size or number of the pixels of a part of the general area MA surrounded (e.g., around a periphery thereof) by the detected afterimage area AIA is smaller than the suitable size or number (e.g., the predetermined or preset size or number) of pixels, the afterimage area correction unit 220 may determine the corresponding area as the false detection area. As shown in FIG. 7, the pixel size L1 of the first false detection area MDA1 in the first direction DR1 and the pixel size L2 thereof in the second direction DR2 may be smaller than the suitable (e.g., the predetermined or preset) pixel size. Accordingly, the afterimage area correction unit 220 may detect the first false detection area MDA1, and may correct the first false detection area MDA1 as the afterimage area (e.g., the corrected after image area) AIA.

The afterimage area detection unit 210 may detect the afterimage area AIA from a plurality of example images, and the afterimage area correction unit 220 may calculate a median value of the pixel size by extracting a plurality of clusters from the detected afterimage area AIA. The afterimage area correction unit 220 may calculate a median value of the pixel size based on the plurality of clusters. For example, the median value of the pixel size may be calculated through a statistical method based on the plurality of clusters, but the present disclosure is not limited thereto. The median value of the pixel size may be a criterion for classifying the false detection area MDA and the general area MA.

When the distance between the afterimage areas detected from the input image IMG is equal to or less than the median value of the pixel size, the afterimage area correction unit 220 may determine the area between the detected afterimage images AIA as the false detection area MDA. The afterimage area correction unit 220 may determine a part of the corresponding general area as the false detection area MDA when an area or a pixel size of a part of the general area MA surrounded by the detected afterimage area AIA is less than or equal to the median value of the pixel size. For example, when the pixel size L1 of the first false detection area MDA1 in the first direction DR1 and the pixel size L2 thereof in the second direction DR2 are less than or equal to the median value of the pixel size, the afterimage area correction unit 220 may detect the first false detection area MDA1. For another example, when the distance DS between the detected afterimage areas AIA is more than (e.g., is greater than) the median value of the pixel size, the afterimage area correction unit 220 may determine the area between the detected afterimage images AIA as the general area MA.

The afterimage area correction unit 220 may correct the false detection area MDA as the corrected afterimage area, and may provide the corrected afterimage area data CAD including the corrected afterimage area information to the compensation data generation unit 230. The afterimage area correction unit 220 may set (e.g., may change) an afterimage area close to (e.g., near or adjacent to) the actual afterimage area CRA by correcting the false detection area MDA as the corrected afterimage area. The compensation data generation unit 230 may generate the compensation data CDATA by adjusting the luminance of the corrected afterimage area.

Figure 8:
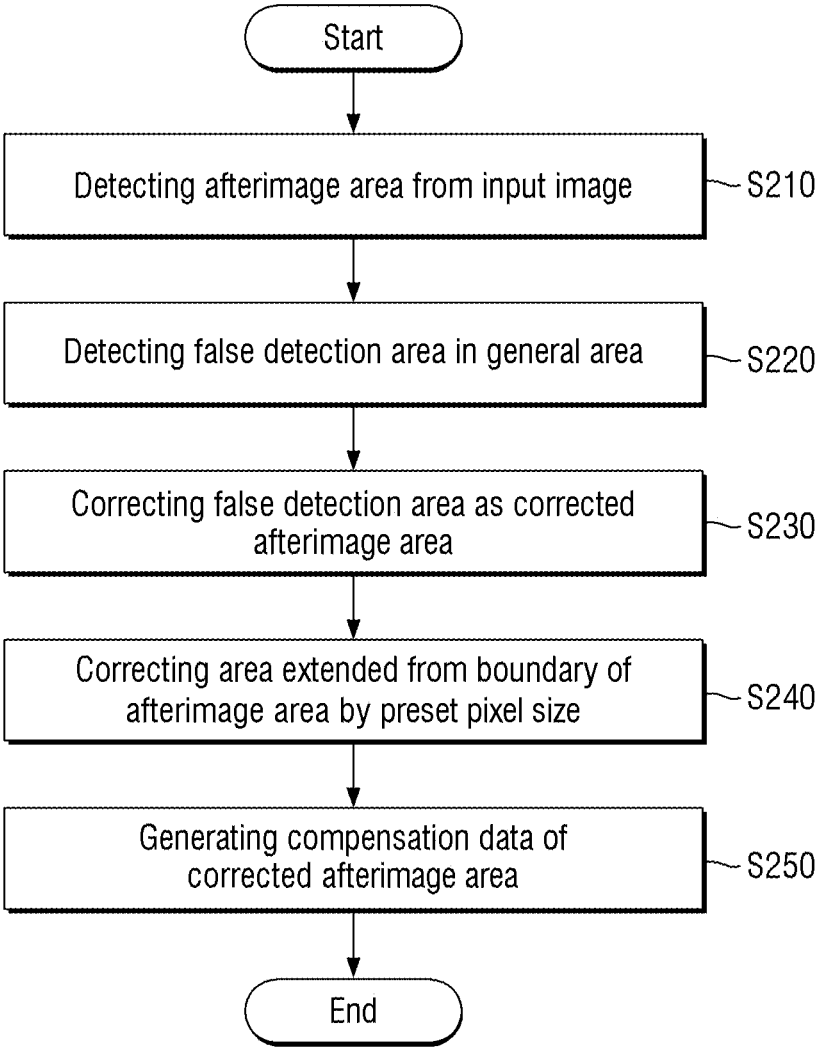
FIG. 8 is a flowchart illustrating an afterimage compensating process according to another embodiment.

FIG. 8 is a flowchart illustrating an afterimage compensating process according to another embodiment. Hereinafter, the same or substantially the same components, elements, and configurations as those of the above-described embodiments may be briefly described, or redundant description thereof may not be repeated.

Referring to FIG. 8, the afterimage compensation device 200 may include the afterimage area detection unit 210, the afterimage area correction unit 220, and the compensation data generation unit 230.

The afterimage area detection unit 210 may receive the input image IMG, and may detect an afterimage area AIA including an afterimage in the input image IMG (block S210). The afterimage area detection unit 210 may provide the afterimage area data AAD including the detected afterimage area information to the afterimage area correction unit 220.

The afterimage area correction unit 220 may detect a false detection area MDA in the general area MA (block S220). The false detection area MDA may correspond to an area surrounded (e.g., around a periphery thereof) in a plurality of directions by the detected afterimage area AIA in a part of the general area MA.

The afterimage area correction unit 220 may correct the false detection area MDA as the corrected afterimage area (block S230).

The afterimage area correction unit 220 may correct an area extended from the boundary of the afterimage area AIA by a suitable pixel size (e.g., a predetermined or preset pixel size) as the corrected afterimage area (block S240). The afterimage area correction unit 220 may determine a pixel size of the extended area in a corresponding direction (e.g., a specific direction) based on the length of the detected afterimage area AIA in the corresponding direction. For example, the afterimage area correction unit 220 may determine a pixel size of the extended area in the first direction DR1 based on the length of the detected afterimage area AIA in first direction DR1.

For example, the pixel size y of the extended area in the corresponding direction may be proportional to the length x of the detected afterimage area AIA in the corresponding direction (e.g., $y=k\times x$, where k is a constant). For another example, the pixel size y of the extended area in the corresponding direction may be proportional to a log value of the length x of the detected afterimage area AIA in the corresponding direction (e.g., $y=\log(x)$). For another example, the pixel size y of the extended area in the corresponding direction may be proportional to an n square root (where n is a natural number of 2 or more) of the length x of the detected afterimage area AIA in the corresponding direction (e.g., $y=x\hat{}(1/n)$). The afterimage area correction unit 220 may provide the corrected afterimage area data CAD including the corrected afterimage area information to the compensation data generation unit 230. The afterimage area correction unit 220 may correct an area extended from the boundary of the afterimage area AIA by the suitable pixel size as the corrected afterimage area, thereby setting (e.g., changing) an afterimage area close to (e.g., near or adjacent to) the actual afterimage area CRA.

The compensation data generation unit 230 may generate the compensation data CDATA by adjusting the luminance of the corrected afterimage area (block S250). The compensation data generation unit 230 may provide the compensation data CDATA to the timing controller 300.

The compensation data generation unit 230 may control the luminance of the corrected afterimage area CAA and/or the luminance of the general area MA adjacent to the corrected afterimage area CAA to naturally adjust the luminance of the display device, thereby preventing or reducing the occurrence of an afterimage, reducing a color shift, and improving display quality.

Figure 9:
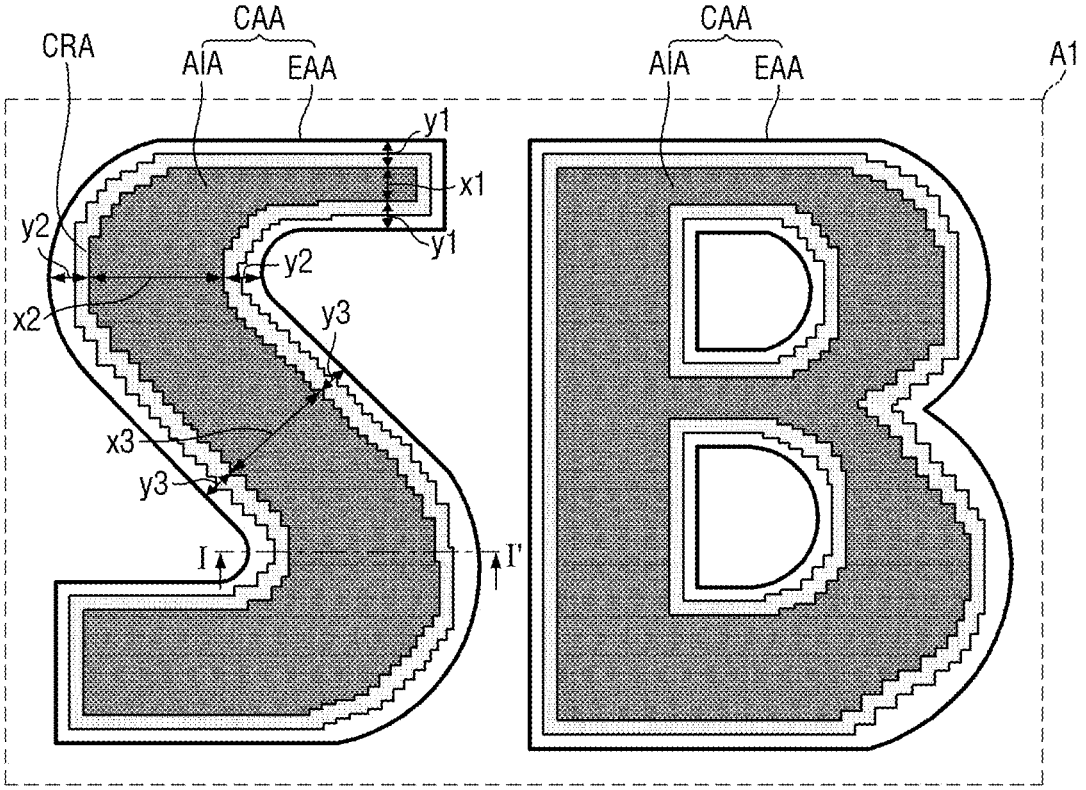
FIG. 9 is an enlarged view of the area A1 in FIG. 5, which illustrates an enlarged afterimage area.
Figure 9:
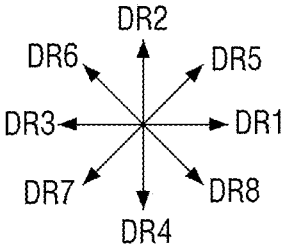

FIG. 9 is an enlarged view of the area A1 in FIG. 5, which illustrates an enlarged afterimage area.

Referring to FIG. 9, the afterimage area correction unit 220 may correct an area EAA extended from the boundary of the afterimage area AIA by a suitable (e.g., a predetermined or preset) pixel size as the corrected afterimage area CAA. The afterimage area correction unit 220 may determine a pixel size of the extended area EAA in a corresponding direction (e.g., in a specific direction) based on the length of the detected afterimage area AIA in the corresponding direction.

The afterimage area correction unit 220 may determine the pixel size y1 of the extended area EAA in the second direction DR2 based on the length x1 of the detected afterimage area AIA in the second direction DR2. For example, the pixel size y1 of the extended area EAA in the second direction DR2 may be proportional to the length x1 of the detected afterimage area AIA in the second direction DR2 (e.g., y1=k×x1, where k is a constant). For another example, the pixel size y1 of the extended area EAA in the second direction DR2 may be proportional to a log value of the length x1 of the detected afterimage area AIA in the second direction DR2 (e.g., y1=log(x1)). For another example, the pixel size y1 of the extended area EAA in the second direction DR2 may be proportional to an n square root (where n is a natural number of 2 or more) of the length x1 of the detected afterimage area AIA in the second direction DR2 (e.g., y1=x1^(1/n)).

The afterimage area correction unit 220 may determine the pixel size y2 of the extended area EAA in the first direction DR1 based on the length x2 of the detected afterimage area AIA in the first direction DR1. For example, the pixel size y2 of the extended area EAA in the first direction DR1 may be proportional to the length x2 of the detected afterimage area AIA in the first direction DR1 (e.g., y2=k×x2, where k is a constant). For another example, the pixel size y2 of the extended area EAA in the first direction DR1 may be proportional to a log value of the length x2 of the detected afterimage area AIA in the first direction DR1 (e.g., y2=log(x2)). For another example, the pixel size y2 of the extended area EAA in the first direction DR1 may be proportional to an n square root (where n is a natural number of 2 or more) of the length x2 of the detected afterimage area AIA in the first direction DR1 (e.g., y2=x2^(1/n)).

The afterimage area correction unit 220 may determine the pixel size y3 of the extended area EAA in the fifth direction DR5 based on the length x3 of the detected afterimage area AIA in the fifth direction DR5. For example, the pixel size y3 of the extended area EAA in the fifth direction DR5 may be proportional to the length x3 of the detected afterimage area AIA in the fifth direction DR5 (e.g., y3=k×x3, where k is a constant). For another example, the pixel size y3 of the extended area EAA in the fifth direction DR5 may be proportional to a log value of the length x3 of the detected afterimage area AIA in the fifth direction DR5 (e.g., y3=log(x3)). For another example, the pixel size y3 of the extended area EAA in the fifth direction DR5 may be proportional to an n square root (where n is a natural number of 2 or more) of the length x3 of the detected afterimage area AIA in the fifth direction DR5 (e.g., y3=x3^(1/n)).

The afterimage area correction unit 220 may provide the corrected afterimage area data CAD including the corrected afterimage area information to the compensation data generation unit 230. The compensation data generator 230 may generate the compensation data CDATA by adjusting the luminance of the corrected afterimage area CAA.

Figure 10:
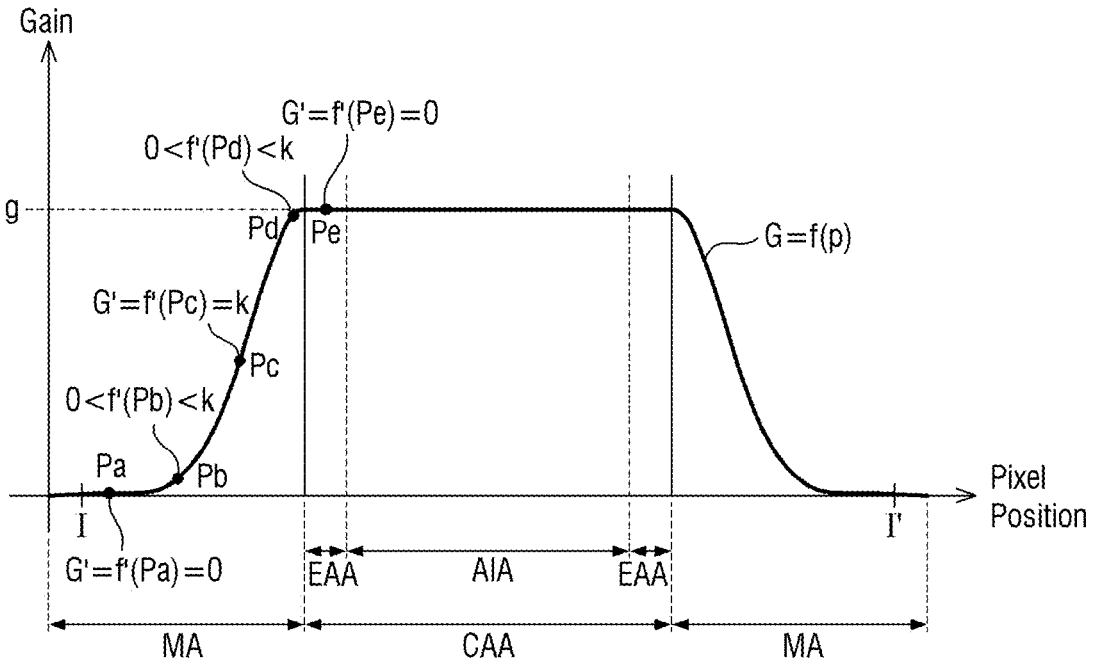
FIG. 10 is a graph illustrating a luminance gain of an afterimage compensation device applied to the area defined by the line I-I' in FIG. 9.

FIG. 10 is a graph illustrating a luminance gain of an afterimage compensation device applied to the area defined by the line I-I' in FIG. 9.

Referring to FIG. 10, the afterimage area correction unit 220 may correct an area EAA extended from the boundary of the afterimage area AIA by a suitable pixel size (e.g., a predetermined or preset pixel size) as the corrected afterimage area CAA. For example, when the luminance of the afterimage area AIA is higher than the luminance around the afterimage area AIA, the afterimage area correction unit 220 may correct the area EAA extended by the suitable pixel size as the corrected afterimage area CAA.

The compensation data generation unit 230 may generate the compensation data CDATA by adjusting the luminance of the corrected afterimage area CAA. For example, the compensation data generation unit 230 may reduce the luminance of the corrected afterimage area CAA by setting (e.g., by changing) the luminance gain G of the corrected afterimage area CAA to be less than 1 (e.g., g<1).

The compensation data generation unit 230 may reduce the luminance of the general area MA adjacent to the corrected afterimage area CAA as the distance from the corrected afterimage area CAA increases. The compensation data generation unit 230 may uniformly or substantially uniformly apply the luminance gain G of the corrected afterimage area CAA (e.g., e.g., G=g), and may reduce the luminance gain G of the general area MA as the distance from the corrected afterimage area CAA increases (e.g., G=f(p)). For example, a fifth point Pe of the luminance gain graph shown in FIG. 10 may correspond to the luminance gain G of the corrected afterimage area CAA, and the luminance gain G of the fifth point Pe may have a value g of less than 1 (e.g., 1>g). The pixel position of each of a fourth point Pd, a third point Pc, a second point Pb, and a first point Pa of the luminance gain graph of FIG. 10 gradually moves away from the afterimage area CAA, and the luminance gain G of each of the fourth point Pd, the third point Pc, the second point Pb, and the first point Pa may gradually decrease.

A magnitude of the derivative G' of the luminance gain G of the general area MA increases as the distance from the corrected afterimage area CAA increases, and then the magnitude of the derivative G' of the luminance gain G may have a maximum value at a specific point, and may decrease as the distance from the corrected afterimage area CAA and the specific point increases. For example, the magnitude of the derivative G' (e.g., G'=f(Pe)) of the fifth point Pe of the luminance gain graph may correspond to 0, and the magnitude of the derivative G' (e.g., G'=f'(Pd)) of the fourth point Pd may be greater than the magnitude of the derivative G' (e.g., G'=f'(Pe)) of the fifth point Pe (where f'(Pd)>f'(Pe)). The magnitude of the derivative G' may increase from the fourth point Pd to the third point Pc, and the magnitude of the derivative G' (e.g., G'=f'(Pc)) of the third point Pc may have a maximum value (e.g., G'=f'(Pc)=k). The magnitude of the derivative G' may decrease from the third point Pc to the second point Pb, and the magnitude of the derivative G' (e.g., G'=f'(Pa)) of the first point Pa may correspond to 0. Accordingly, the compensation data generation unit 230 may control the luminance of the corrected afterimage area CAA and the luminance of the general area MA adjacent to the corrected afterimage area CAA to naturally adjust the luminance of the display device, thereby preventing or reducing the occurrence of an afterimage, reducing a color shift, and improving a display quality.

Figure 11:
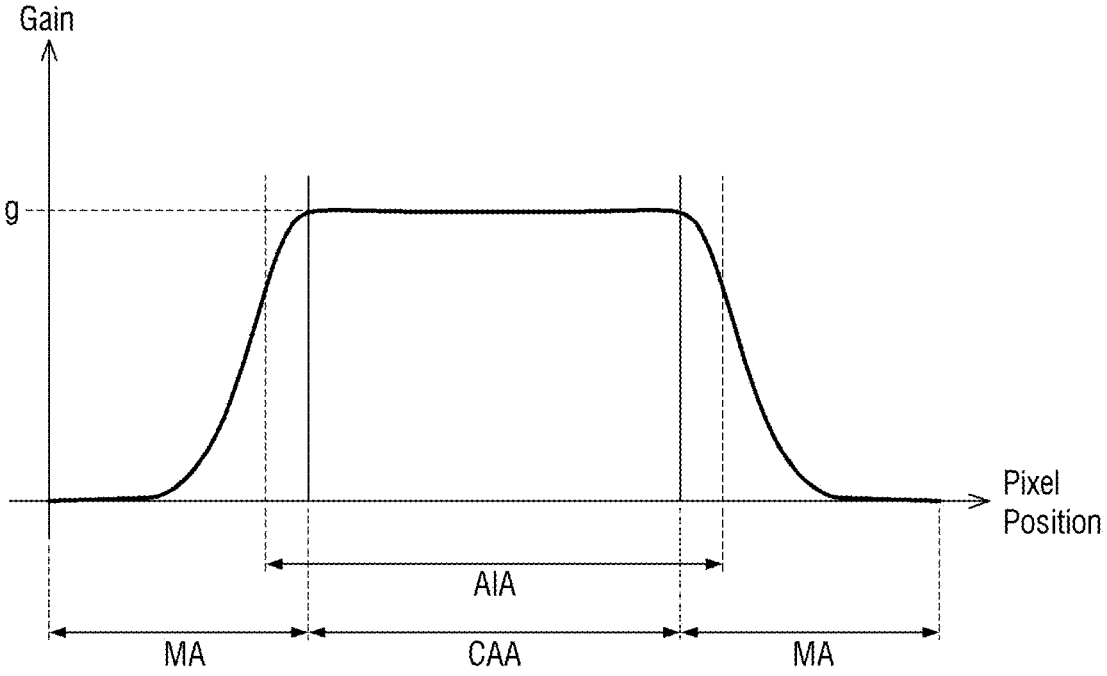
FIG. 11 is a graph illustrating a luminance gain of an afterimage compensation device according to another embodiment.

FIG. 11 is a graph illustrating a luminance gain of an afterimage compensation device according to another embodiment. The luminance gain graph of FIG. 11 may be applied when the area of the corrected afterimage area CAA is smaller than the area of the detected afterimage area AIA.

Referring to FIG. 11, the afterimage area correction unit 220 may correct an area EAA reduced from the boundary of the afterimage area AIA by a suitable pixel size (e.g., a predetermined or preset pixel size) as the corrected afterimage area CAA. For example, when the luminance of the afterimage area AIA is lower than the luminance around the afterimage area AIA, the afterimage area correction unit 220 may correct the area EAA reduced by the suitable pixel size as the corrected afterimage area CAA.

The compensation data generation unit 230 may generate the compensation data CDATA by adjusting the luminance of the corrected afterimage area CAA. For example, the compensation data generation unit 230 may reduce the luminance of the corrected afterimage area CAA by setting (e.g., by changing) the luminance gain G of the corrected afterimage area CAA to be less than 1 (e.g., $g<1$).

The compensation data generation unit 230 may reduce the luminance of the general area MA adjacent to the corrected afterimage area CAA as the distance from the corrected afterimage area CAA increases. The magnitude of the derivative G' of the luminance gain G of the general area MA increases as the distance from the corrected afterimage area CAA increases, then may have a maximum value at a specific point, and may decrease as the distance from the corrected afterimage area CAA and the specific point increases.

Figure 12:
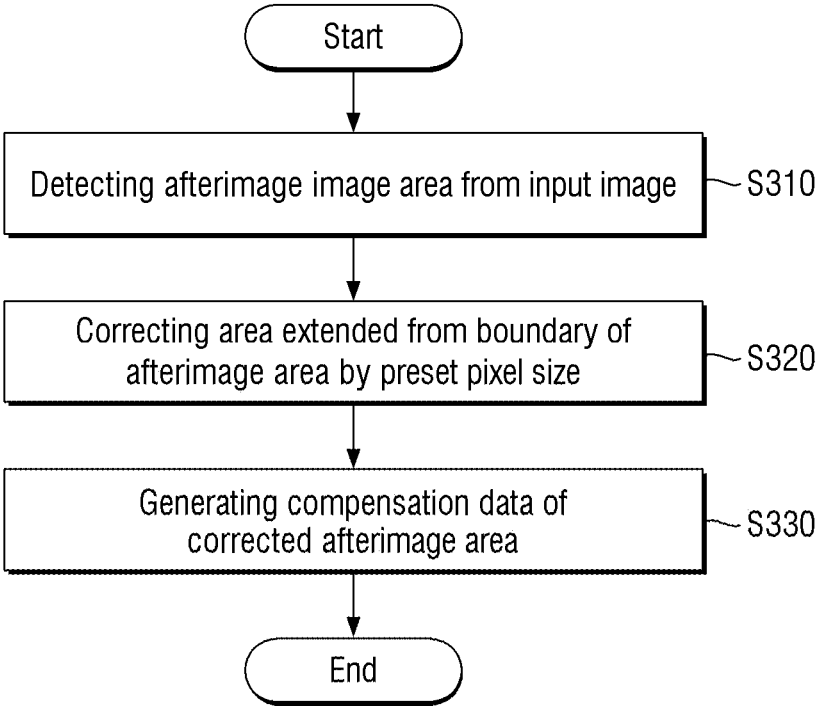
FIG. 12 is a flowchart illustrating an afterimage compensating process according to another embodiment.

FIG. 12 is a flowchart illustrating an afterimage compensating process according to another embodiment. The afterimage compensation process of FIG. 12 may be performed by omitting the blocks S220 and S230 in the afterimage compensation process of FIG. 8.

Referring to FIG. 12, the afterimage compensation device 200 may include the afterimage area detection unit 210, the afterimage area correction unit 220, and the compensation data generation unit 230.

The afterimage area detection unit 210 may receive the input image IMG, and may detect an afterimage area AIA including an afterimage in the input image IMG (block S310). The afterimage area detection unit 210 may provide the afterimage area data AAD including the detected afterimage area information to the afterimage area correction unit 220.

The afterimage area correcting unit 220 may correct the area EAA extended from the boundary of the afterimage area AIA by a suitable pixel size (e.g., a predetermined or preset pixel size) as the corrected afterimage area (block S320). The afterimage area correcting unit 220 may determine a pixel size of the extended area in a corresponding direction (e.g., a specific direction) based on the length of the detected afterimage area AIA in the corresponding direction. For example, the afterimage area correction unit 220 may determine a pixel size of the extended area in the first direction DR1 based on the length of the detected afterimage area AIA in the first direction DR1. The afterimage area correction unit 220 may provide the corrected afterimage area data CAD including the corrected afterimage area information to the compensation data generation unit 230.

The compensation data generation unit 230 may generate the compensation data CDATA by adjusting the luminance of the corrected afterimage area (block S330). The compensation data generation unit 230 may provide the compensation data CDATA to the timing controller 300.

The compensation data generation unit 230 may control the luminance of the corrected afterimage area CAA and the luminance of the general area MA adjacent to the corrected afterimage area CAA to naturally adjust the luminance of the display device, thereby preventing or reducing the occurrence of an afterimage, reducing a color shift, and improving display quality.

The aspects and features of the present disclosure are not limited by the foregoing, and other various aspects and features are contemplated herein.

Although some example embodiments have been described, those skilled in the art will readily appreciate that various modifications are possible in the example embodiments without departing from the spirit and scope of the present disclosure. It will be understood that descriptions of features or aspects within each embodiment should typically be considered as available for other similar features or aspects in other embodiments, unless otherwise described. Thus, as would be apparent to one of ordinary skill in the art, features, characteristics, and/or elements described in connection with a particular embodiment may be used singly or in combination with features, characteristics, and/or elements described in connection with other embodiments unless otherwise specifically indicated. Therefore, it is to be understood that the foregoing is illustrative of various example embodiments and is not to be construed as limited to the specific example embodiments disclosed herein, and that various modifications to the disclosed example embodiments, as well as other example embodiments, are intended to be included within the spirit and scope of the present disclosure as defined in the appended claims, and their equivalents.

What is claimed is:

1. An afterimage compensation device comprising:

an afterimage area detector configured to receive an input image, and detect an afterimage area comprising an afterimage in the input image;

an afterimage area corrector configured to detect a false detection area, and generate a corrected afterimage area, the false detection area being a part of a general area that is not detected as the afterimage area and surrounded in a plurality of directions by the detected afterimage area; and a compensation data generator configured to adjust a luminance of the corrected afterimage area to generate compensation data.

2. The afterimage compensation device of claim 1, wherein the afterimage area corrector is configured to determine an area that is surrounded in at least three directions from among an upward direction, a downward direction, a left direction, and a right direction by the afterimage area in which the part of the general area is detected as the false detection area.

3. The afterimage compensation device of claim 1, wherein the afterimage area corrector is configured to determine an area in which a boundary surface of the part of the general area has a radius of curvature lower than a preset radius of curvature as the false detection area.

4. The afterimage compensation device of claim 1, wherein the afterimage area corrector is configured to determine the part of the general area as the false detection area when a size or a number of pixels of the part of the general area surrounded by the detected afterimage area is smaller than a preset size or number of pixels.

5. The afterimage compensation device of claim 1, wherein the afterimage area detector is configured to receive a plurality of example images, and detect an afterimage area of each of the plurality of example images, and wherein the afterimage area corrector is configured to receive a designated false detection area designated based on the afterimage area of each of the plurality of example images, and cluster a pixel size of the designated false detection area to store a plurality of clusters according to a result of the clustering.

6. The afterimage compensation device of claim 5,
wherein the afterimage area corrector is configured to calculate a median value of the pixel size based on the plurality of clusters, and
wherein the afterimage area corrector is configured to determine an area between afterimage areas detected from the input image as the false detection area when a distance between the afterimage areas detected from the input image is equal to or less than the median value of the pixel size.

7. The afterimage compensation device of claim 5,
wherein the afterimage area corrector is configured to calculate a median value of the pixel size based on the plurality of clusters, and
wherein the afterimage area corrector is configured to determine an area between detected afterimage areas as the general area when a distance between the detected afterimage areas detected from the input image is more than the median value of the pixel size.

8. The afterimage compensation device of claim 1,
wherein the afterimage area corrector is configured to correct an extended area extended from a boundary of the after image detected from the afterimage area detector by a preset pixel size as the corrected afterimage area.

9. The afterimage compensation device of claim 8,
wherein the afterimage area corrector is configured to determine a pixel size of the extended area in a corresponding direction based on a length of the detected afterimage area in the corresponding direction.

10. The afterimage compensation device of claim 9,
wherein the pixel size of the extended area in the corresponding direction is proportional to the length of the detected afterimage area in the corresponding direction, is proportional to a log value of the length of the detected afterimage area in the corresponding direction, or is proportional to an n square root of the length of the detected afterimage area in the corresponding direction, where n is a natural number of 2 or more.

11. The afterimage compensation device of claim 8,
wherein the compensation data generator is configured to reduce a luminance of the general area adjacent to the corrected afterimage area as a distance from the corrected afterimage area increases.

12. The afterimage compensation device of claim 8,
wherein the compensation data generator is configured to uniformly apply a luminance gain of the corrected afterimage area, and reduce a luminance gain of the general area as a distance from the corrected afterimage area increases.

13. The afterimage compensation device of claim 12,
wherein a magnitude of a derivative of the luminance gain of the general area increases as a distance from the corrected afterimage area increases, reaches a maximum value at a specific point, and decreases as a distance from the corrected afterimage area and the specific point increases.

14. An afterimage compensation device comprising:
an afterimage area detector configured to receive an input image, and detect an afterimage area comprising an afterimage in the input image;
an afterimage area corrector configured to correct an extended area extended from a boundary of the detected afterimage area by a preset pixel size as a corrected afterimage area; and
a compensation data generator configured to adjust a luminance of the corrected afterimage area to generate compensation data,
wherein the afterimage area corrector is configured to determine a pixel size of the extended area in a corresponding direction that is proportional based on a length of the detected afterimage area in the corresponding direction.

15. The afterimage compensation device of claim 14,
wherein the pixel size of the extended area in the corresponding direction is proportional to the length of the detected afterimage area in the corresponding direction, is proportional to a log value of the length of the detected afterimage area in the corresponding direction, or is proportional to an n square root of the length of the detected afterimage area in the corresponding direction, where n is a natural number of 2 or more.

16. The afterimage compensation device of claim 14,
wherein the compensation data generator is configured to uniformly apply a luminance gain of the corrected afterimage area, and reduce a luminance gain of a general area as a distance from the corrected afterimage area increases.

17. The afterimage compensation device of claim 16,
wherein a magnitude of a derivative of the luminance gain of the general area increases as a distance from the corrected afterimage area increases, reaches a maximum value at a specific point, and decreases as a distance from the corrected afterimage area and the specific point increases.

18. A display device comprising:
an afterimage compensation device configured to detect an afterimage area from an input image, correct the detected afterimage area to generate a corrected afterimage area, and output compensation data applied to the corrected afterimage area;
a timing controller configured to generate pixel data based on the compensation data; and
a display panel configured to display an image based on the pixel data,
wherein the afterimage compensation device comprises:
an afterimage area detector configured to receive the input image, and detect the afterimage area comprising an afterimage in the input image;
an afterimage area corrector configured to detect a false detection area, and generate the corrected afterimage area, the false detection area being in a part of a general area not detected as the afterimage area and surrounded in a plurality of directions by the detected afterimage area; and
a compensation data generator configured to adjust a luminance of the corrected afterimage area to generate the compensation data.

19. The display device of claim 18,
wherein the afterimage area detector is configured to receive a plurality of example images, and detect an afterimage area of each of the plurality of example images, and
wherein the afterimage area corrector is configured to receive a designated false detection area designated based on the afterimage area of each of the plurality of example images, calculate a median value of a pixel size based on a plurality of clusters obtained by clustering the pixel size of the false detection area, and detect the false detection area based on the median value of the pixel size.

20. The display device of claim 18, wherein the afterimage area corrector is configured to correct an area extended from a boundary of the afterimage area detected from the afterimage area detector by a preset pixel size as the corrected afterimage area.

* * * * *